US006073819A

United States Patent [19]

Wing

[11] Patent Number: 6,073,819

[45] Date of Patent: Jun. 13, 2000

[54] FLEXIBLE NON SLIP GARMENT HANGER

[76] Inventor: Kathleen A Wing, P.O. Box 277, 42 Elm St., Nassau, N.Y. 12123

[21] Appl. No.: 09/266,433

[22] Filed: Mar. 11, 1999

Related U.S. Application Data

[60] Provisional application No. 60/077,832, Mar. 13, 1998.

[51] Int. Cl.[7] ..... A47G 25/20; A47G 25/30

[52] U.S. Cl. ..... 223/89; 223/94; 223/98

[58] Field of Search ..... 223/88, 85, 92, 223/98, 94, 89; D6/315

[56] References Cited

U.S. PATENT DOCUMENTS

| | | | |
|---|---|---|---|
| 2,814,426 | 11/1957 | Miller . | |
| 3,443,729 | 5/1969 | Hannum . | |
| 3,537,625 | 11/1970 | Nuttall | 223/85 |
| 4,717,053 | 1/1988 | Wang . | |
| 4,905,877 | 3/1990 | Gatling . | |
| 4,981,242 | 1/1991 | Grahm | 223/94 |
| 5,046,649 | 9/1991 | Hazenveld . | |
| 5,083,152 | 1/1992 | Chen . | |
| 5,085,358 | 2/1992 | Lam . | |
| 5,145,098 | 9/1992 | Tung . | |
| 5,170,916 | 12/1992 | Kolton et al. . | |
| 5,277,345 | 1/1994 | Ozaki . | |
| 5,344,054 | 9/1994 | Nutter . | |
| 5,476,199 | 12/1995 | Halverson et al. . | |
| 5,511,701 | 4/1996 | Lam . | |
| 5,535,927 | 7/1996 | Garrison . | |
| 5,613,627 | 3/1997 | Marks . | |
| 5,613,628 | 3/1997 | Burkhalter | 223/85 |
| 5,664,710 | 9/1997 | Lam . | |
| 5,711,464 | 1/1998 | Huang . | |
| 5,718,358 | 2/1998 | Long et al. . | |
| 5,718,362 | 2/1998 | Silverman . | |
| 5,826,759 | 10/1998 | Ohsugi . | |

*Primary Examiner*—Bibhu Mohanty
*Attorney, Agent, or Firm*—Allan Jacobson

[57] ABSTRACT

A hanger with a rigid hook and neck centered perpendicularly to a shoulder has left and right opposing arms protruding at an angle from the shoulder portion. The stationary arms are made of a sturdy rigid material to provide the support necessary to hold garments of a heavy weight such as overcoats and wet sweaters. A flexible arm portion at the end of each stationary arm of the hanger is contorted by hand to any shape, which shape is retained without the aid of external support. The rigid stationary arms and the flexible arm portions are covered with flexible foam with an outer non-slip surface. The diameter of the flexible foam is made sufficiently ample to support a weighty garment and distribute the weight of the garment, in addition to providing a sufficiently large non-slip surface. The flexible hanger is adjustable and re-adjustable to conform to the shape of the desired garment and retain its shape without external support.

17 Claims, 10 Drawing Sheets

FLEXIBLE NON SLIP GARMENT HANGER

CROSS REFERENCES TO RELATED APPLICATIONS

Applicant hereby claims the benefit of priority of U.S. provisional patent application Ser. No. 60/077,832 filed Mar. 13, 1998.

FIELD OF THE INVENTION

This invention relates generally to devices from which clothes are hung. More specifically, the present invention relates to clothes hangers that can adapt to clothing articles of varying size and materials.

BACKGROUND OF INVENTION

Clothing which is worn over the shoulder and arms such as sweaters, shirts and coats come in many shapes and sizes. However the majority of the conventional type hangers come in only one size. Conventional hangers usually are made of wire or rigid plastic or metal rods providing a hook and neck centered perpendicularly to a shoulder with left and right opposing arms protruding at a downward angle. Consequently clothing, specifically those articles of clothing with a neck portion, shoulders and arms, may be too narrow or too wide across the shoulder lines for a conventional hanger. In such situations the article of clothing does not hang on the hanger properly and is at risk of becoming permanently distorted by the hanger. Typical distortion as caused by creasing, stretching or over stressing localized areas of the clothing fabric, specifically in the neck, which is pulled in either direction from its center downward. Also prone is the shoulder region where bumps may develop as the weight of the clothing article pulls downward with gravity and the tips of the standard garment hanger push out at the shoulder area causing protrusions or bumps in the region. This distortion problem becomes worse with heavier garments e.g.: overcoats, jackets and sweaters, especially with open weaves. Knit garments are particularly prone to the problem of distortion.

In addition, the conventional garment hanger is often made from wire or of molded, virgin or recycled plastic or polymer material and mixtures thereof that produce a smooth, slick or slippery surface, which allows the garment to easily slide down or off the hanger. A garment of a knitted construction or of a stretchable material pulls downward with gravity from the center of the neck opening on either or both sides of the shoulder line causing a garment to distort from its original shape.

In addition, some articles of clothing require special wash and dry considerations. It is not advisable to dry any sweaters or knit in the clothes dryer due to shrinkage problems. Since hanging wet items produces significant distortions in the neck and shoulder areas of the garment, wet items need to be laid on a flat surface to dry, which is not always convenient.

Because the conventional garment hanger fails to provide the means of addressing different sized garments and does not adequately support some garments such as sweaters, knits and stretchable, a conventional hanger fails the retail merchandisers necessity to display their clothing articles attractively.

In order to provide background information so that the invention may be completely understood and appreciated in its proper context, reference is made to a number of prior patents including flexible, adjustable and slip resistant hangers. For example:

U.S. Pat. 5,826,759 (1997) to Ohaugi, discloses a hanger formed of two loops of flexible material, each having a first and second end for suspending clothing. Resizing of the hanger is done with a mechanical apparatus located under and behind the hook used to hang hanger from a rod. The flexible units of this hanger rely on maintaining their position through the same mechanical devices.

U.S. Pat. No. 5,711,464 (1996) to Huang discloses a length adjustable clothes hanger comprised of flexible arms with an elongated restraining member having two ends that contain and maintain the hanger arms in place.

U.S. Pat. No. 5,718,358 (1996) to Long, Lowman and Lord discloses and extensible clothes hanger. The hanger includes extending, planar members that extend or retract into a central base. Movement of the extending planar members is accomplished when a person presses down the center button, that is situated on either arm, and then pulling outward or pushing inward. Hanger must therefore be adjusted before clothing article is hung upon the hanger.

U.S. Pat. No. 5,718,362 (1996) to Silverman discloses a telescopic sleeve device that is moveable in either direction allowing the hanger to maintain a small or a large profile but made of smooth molded plastic and clothes can easily miss align.

U.S. Pat. No. 5,664,710 (1996) to Ar-Fu Lam discloses a hanger with extendible arms through a means of gears and ratchets.

U.S. Pat. No. 5,613,627 (1995) to Marks discloses a hanger with two inclined arms with an integrally formed locking bar that extends from the integral base to a free distal end.

U.S. Pat. No. 5,535,927 (1994) to Garrison discloses a non slip hanger but without any adjustably function.

U.S. Pat. No. 5,511,701 (1994) to Lam discloses an adjustable width garment hanger made of a rigid material having a gear and ratchet system that allows the hanger arms to move in a longitudinal way.

U.S. Pat. No. 5,476,199 (1994) to Halverson and Halverson discloses and extendible clothes hanger that uses movably adjustable, extendible clothing support arms enabling the side to side or lateral extension of hanger. Hanger is of the plastic type with a thin frame that could cause stress to clothing materials.

U.S. Pat. No. 5,344,054 (1992) to Nutter an adjustable hanger made of a rigid material that uses a laterally disposed spring and screw tension device to secure each of the laterally adjustable arms.

U.S. Pat. No. 5,277,345 (1992) to Ozaki is a standard sized hanger made of a rigid material with the added application of a slip resistant material situated on the top of each of the hanger arm tips.

U.S. Pat. No. 5,170,916 (1991) to Kolton is a standard sized hanger with flexible raised pads placed on the top of each hanger arm surface to resist slipping of garments. There is no means for size adjustment.

U.S. Pat. No. 5,145,098 (1991) to Tung discloses a foldable and telescopic garment hanger made of a rigid material with a pair of sliding arm members telescopically mounted to stationary arms.

U.S. Pat. No. 5,085,358 (1990) to Lam discloses a hanger with arms that move along the stationary arms to a desired length. The extender arms also have shoulder support pads. Hanger does not have any slip resistant features.

U.S. Pat. No. 5,082,152 (1990) discloses a garment hanger with adjustable clamping crossbar embodies two shoulder members bifurcated from the central member and providing extendible shoulder members. Made of rigid material this invention would need to be adjusted before garment is placed upon it.

U.S. Pat. No. 5,046,649 (1990) to Hazenveld discloses a garment hanger having cooperative interconnected resilient and flexible members. Flexible arm members must be adjusted and held into place via a restraining member.

U.S. Pat. No. 4,905,877 (1989) to Gatling discloses an adjustable hanger made of a rigid material with moving sleeves that have a smooth surface.

U.S. Pat. No. 4,717,053 (1987) to Wang discloses a hanger with sliding shoulder sections that are set to the desired length with a button that employs its opening on the opposing section.

U.S. Pat. No. 3,443,729 (1967) to Hannum discloses a hanger with telescoping shoulder extensions.

U.S. Pat. No. 2,814,426 (1954) to Miller discloses a hanger with telescoping adjustable shoulders.

While the clothes hanger arrangements shown by the above prior art generally provide adjustable means for supporting garments of variable sizes, and hangers with slip resistant features, none of these patented hangers, together or combined, discloses or suggests the overall design and configuration of the present invention. All of the flexible, slip resistant garment hangers heretofore known suffer from one or more of the following disadvantages:

a) Overly complicated designs. Some include gears, ratchets, wheels, restraining members, buttons, slots and locking mechanisms.
b) Difficulty sizing the hanger. Many of the above patented hangers have two or mechanisms that need to be adjusted via buttons, slides, ratchets, gears.
c) Difficulty customizing hanger to garment. Because of the design many of the above patented hangers need to be adjusted before the garment is hung thus reducing the probability of an exact fit.
d) Narrowness of the arm diameter. Distribution of weight is limited and thereby stresses materials burdened upon the hanger's narrow diameter. Specifically a sweater, knit, heavy or a wet garment hung to dry is exceptionally prone to stress.
f) Lack of true flexibility. Many of the above hangers include the word 'flexible' in the title but are actually rigid in nature, and can not mimic the human shape.

All of the above patented hangers do not offer a flexibility with a directionally unlimited range of motion or the ability to imitate the movements of a human arm, therefore they are not desirable for the retail display industry.

SUMMARY OF THE INVENTION

The present invented hanger, with its simplicity of use and design, is easily adjusted to a desired shape. The hangar is not only flexible by hand to conform to any shape but also has a memory to maintain its position or reconfiguration with out the aid of a clamp or other device necessary to hold it in shape. The present invention further has a non-slip surface over the body of the hanger arms. Many of the prior art extendible, telescopic and adjustable hangers listed above are difficult to use and require the adjustments to be made before the garment is hung. The present invented hanger can be easily adjusted with the garment either pre-hung or not hung prior to the adjustment. In addition, the present invention provides a slip resistant and form-fitting hanger that can also be used to hang wet clothing articles to dry. The present invention also provides a directionally unlimited range of motion and gives articles of clothing a realistic human shape so that the present invention may be employed as a mannequin type device in a retail merchandising environment. In addition, the present invention uses materials that can withstand repeated twisting, contorting, bending and shaping without damage to the flexible arms and components thereof. The hanger according to the present invention achieves advantages in simplicity of use, design, construction and cost.

The present invention, briefly described, provides a clothes hanger with a frame providing a rigid hook and neck centered perpendicularly to a shoulder with left and right opposing arms protruding at an angle. The opposing arms are made of a sturdy relatively rigid material such as steel, hardened metals, plastics or wood. The opposing arms being relatively rigid and stationary provide the support necessary to hold a heavy weight garment such as an overcoat and a wet sweater. The extendible, relatively flexible portion of the hanger is provided by a malleable wire that can be contorted to any shape and retain that shape with out the need for extraneous devices. The rigid and flexible members are joined together by means of soldering, welding, locking or fastening.

Both the relatively rigid stationary arms and the relatively malleable wire flexible arm portions are then covered with a flexible foam tube called the foam housing. This foam housing has a center aperture equal to the length of the foam housing. The length of the foam housing is greater than the combined length of the rigid and flexible arm assembly.

The foam housing is preferably made from a polyvinyl nitrite or other such flexible open celled foams or materials that provide the desired profile. The foam housing should also be skinned, that is to say removal of outer smooth layer if one so exists, so as to provide a textured and slip free surface. The outside diameter of the foam housing should be massive enough to provide a support surface that is well rounded and distributes the weight of the garment and therefore decreases the stress to clothing caused by a thin wire or plastic hanger.

In one embodiment, the relatively malleable flexible arm portions are made of a malleable foam portion, thereby avoiding the need for a malleable wire. In accordance with the present invention, the resulting assembly has a relatively rigid less malleable section for supporting the main weight of the garment, while providing a relatively more malleable section which can be deformed by hand to a desired shape, and retain that desired shape without external support.

The present invention provides a simple one piece product design (a single assembly without moving parts) that allows superior ease of use, including arms that can be easily manipulated to increase or decrease the length and the configuration of the hanger arms to fit clothing of any size. The flexible hanger arms may both be independently and continuously adjustable from any position. When arms have been placed in the desired position they are capable of maintaining that shape without the aid of any extraneous devises or mechanisms. Arms may be of a diameter many times the diameter of a conventional hanger thereby distributing the weight of garment over a larger area and reducing localized stress to the material area directly in contact with the hanger unit. The relatively thick combination of a malleable wire with a dense foam housing are sufficiently massive so that they effectively hold the weight of a heavy garment i.e., a wet sweater or a man's large overcoat. The exterior or housing member is of a slip resistant and flexible foam material that provides a hanger that not only maintains its shape, but also the shape of the garment being placed upon it, including small, large, heavy weights, knits, sweaters, and open weave garments.

The hanger of the present invention can also be manufactured with a pant bar or skirt clips mounted to and below the rigid frame. The present invented hanger withstands repeated twisting, contorting, bending and shaping without damage or distress to the flexible arms and components. The flexible portion of the present invention has a directionally unlimited range of motion mimicking the arm portions of a human body and is therefore desirable for the retail industry as a clothing display mannequin.

Additional features of the invention are described in the detailed description below, and in the claims appended hereto. The invention is not limited to the details of construction and to the arrangements of the components set forth in the following description or illustrated in the drawings. The invention is capable of other embodiments and of being practiced and carried out in a variety of ways. Also, it is to be understood that the phraseology and terminology employed herein are for the purpose of conception, upon which this disclosure is based, may readily be utilized as a basis for designing other structures, methods and systems, for carrying out the several purposes of the present invention. It is important, therefore, that the claims be regarded as including such equivalent constructions insofar as they do not depart from the spirit and scope of the present invention.

DETAILED DESCRIPTION

Figure 1:
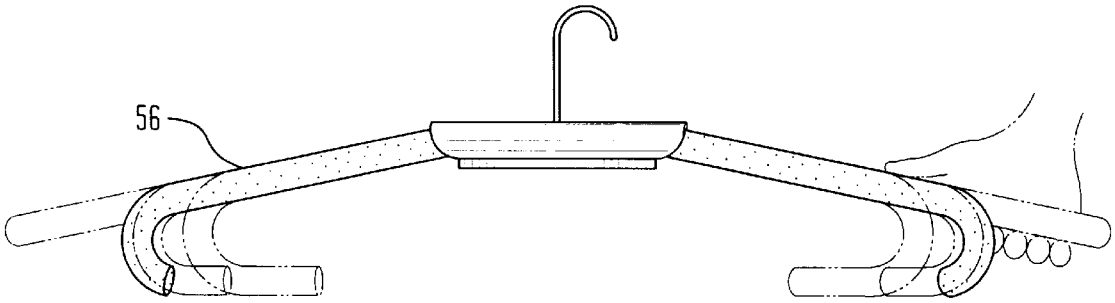
FIG. 1 is a perspective view of a flexible hanger in accordance with the present invention.

For a better understanding of the present invention, its operating advantages and the specific objects attained by its uses, reference is now made to the accompanying drawings and descriptive matter in which are illustrated the most preferred embodiments of the invention. Since the left and right sides of all embodiments are exactly the same wherever the left side or the right side is mentioned it should be assumed to be inclusive.

Reference Numerals in Drawings

| | |
|---|---|
| 22 | neck |
| 23 | hook |
| 24 | shoulder |
| 25 | tip left rigid arm |
| 26 | left rigid arm |
| 26a | length left rigid arm |
| 27 | tip right rigid arm |
| 28 | right rigid arm |
| 28a | length right rigid arm |
| 29 | hanger frame assembly |
| 30 | skirt clamp |
| 31 | hanger frame and malleable wire assembly |
| 32 | pant bar |
| 33 | malleable foam housing |
| 34 | malleable wire |
| 34a | length malleable wire |
| 35 | crimp |
| 36 | foam housing |
| 36a | length foam housing |
| 37 | far most tip of foam housing |
| 38 | foam housing tip located at hanger frame end |
| 39 | distance of collar and foam housing engagement |
| 40 | malleable wire tip |
| 42 | foam aperture diameter |
| 44 | foam outside diameter |
| 46 | wire attachment |
| 47 | end cap |
| 48 | plug |
| 50 | plug head |
| 52 | plug nipple |
| 53 | collar with integral hook |
| 54 | collar |
| 56 | flexible arm extensions assembly |
| 59 | outside diameter of rigid arm |
| 60 | distance between malleable wire and plug |

-continued

| | |
|---|---|
| 62 | teeth |
| 64 | ramp |
| 66 | vertically positioned bar |
| 70 | diameter malleable wire |
| 74 | bottom edge of collar |
| 76 | protrusion |
| 78 | receptacle |
| 80 | bottom inside edge of plug head |
| 84 | outside diameter of nipple |
| 85 | formed bar |
| 86 | straight bar |
| 87 | foam housing aperture |
| 88 | foam aperture diameter for vertical bar |
| 90 | bottom edge of foam housing |
| 92 | slit |
| 93 | long slit |
| 96 | plastic hook |
| 98 | plastic neck |
| 101 | arm embellishment spherical |
| 102 | collar logo embellishment |
| 103 | arm embellishment star |

Figure 5:
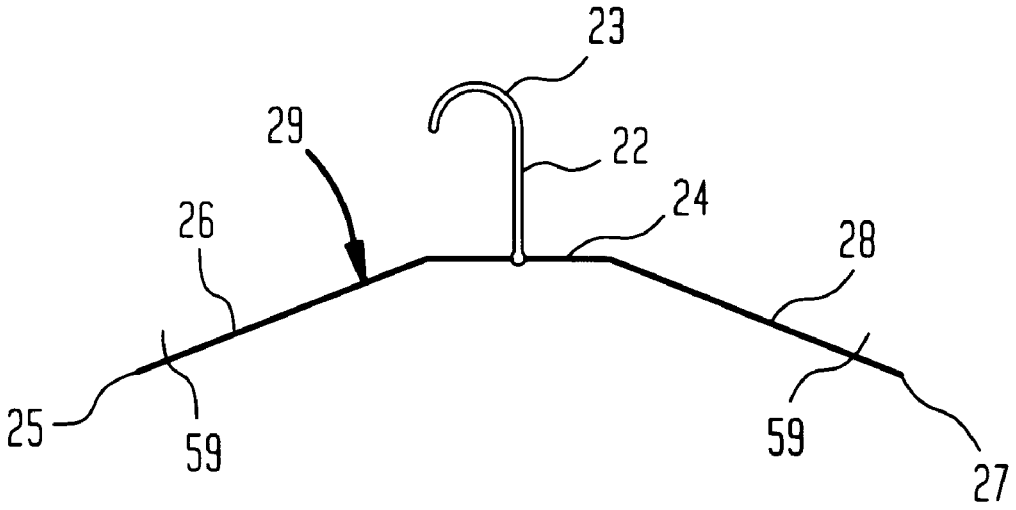
FIG. 5 is a front view of hanger frame assembly used in conjunction with the present invention.
Figure 6:
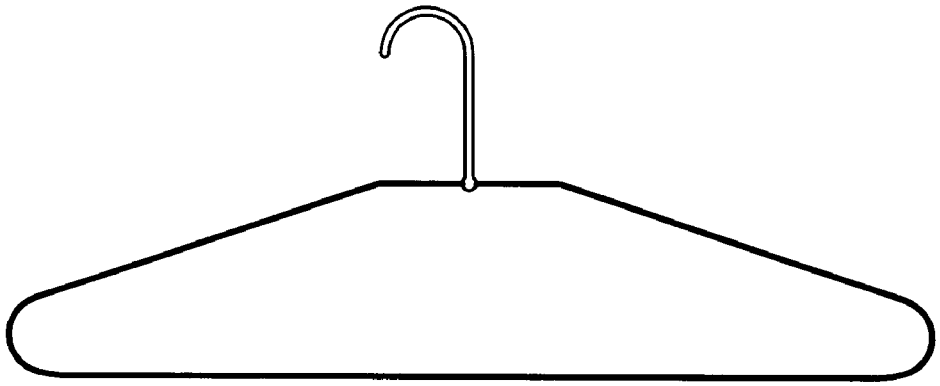
FIG. 6 (PRIOR ART)
FIG. 6 is a front view of a conventional prior art hanger.
Figure 7:
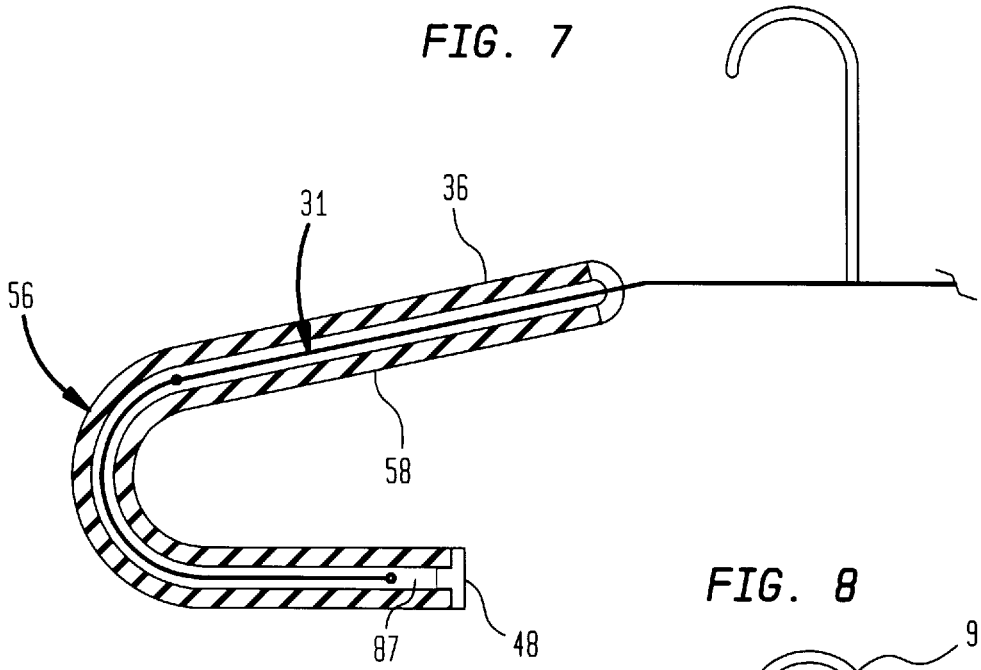
FIG. 7 is a front view of arm assembly in accordance with the present invention.

FIG. 1 shows the present invention with left and right arm assembly, in positions representing some of the many positions the flexible arm extensions 56 (FIG. 7) can achieve. FIG. 1 is intended for garments with shoulders and or arms. The hanger frame as shown in FIG. 5 includes a hook 23, neck 22 centered perpendicularly to a shoulder 24 and having opposing left rigid arm 26 and right rigid arm 28 that mimic the top portion of a conventional hanger (FIG. 6). It is preferable that the hanger frame 29 be made of a steel, hardened metals, stiff plastics or wood material or any other material that will provide the hanger frame 29 with a rigid profile strong enough to hold relatively heavy garments.

Figure 10:
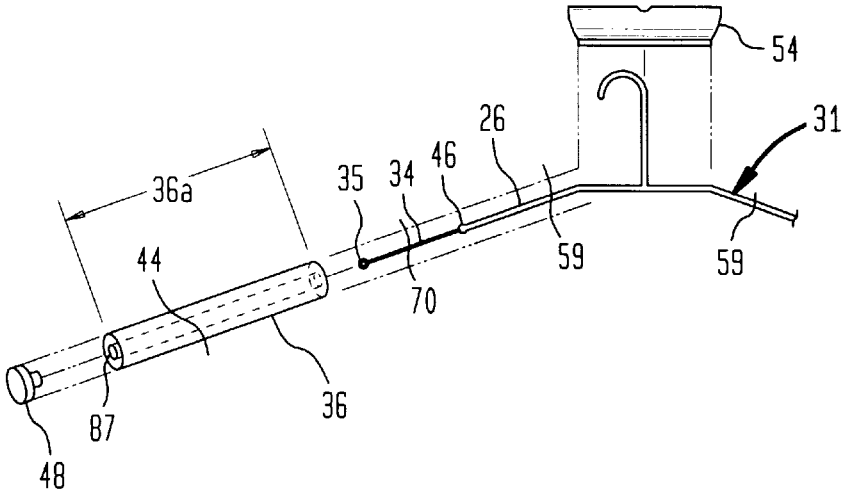
FIG. 10 is an assembly view of hanger arms with malleable wire attached to hanger frame in accordance with the present invention.
Figure 10A:
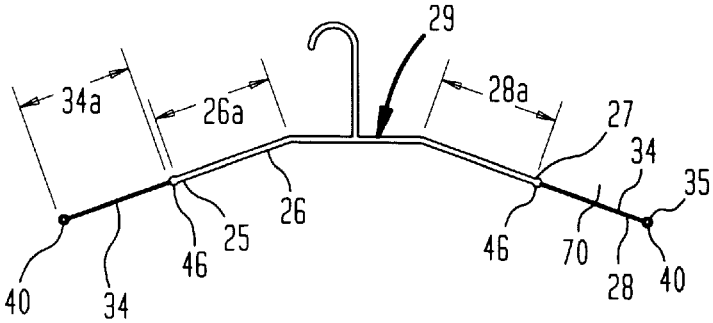
FIG. 10*a* is a front view of hanger frame with malleable wires attached in accordance with the present invention.
Figure 11:
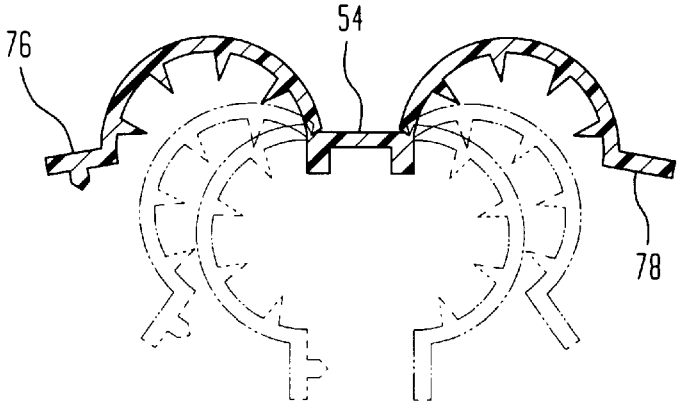
FIG. 11 is a side view of FIG. 9 in the opened position.

The hanger frame 29 has at the tip 25 of the left rigid arm 26 a malleable wire 34 attached 46 (FIG. 10*a*) In addition, at the tip 27 of right rigid arm 28 a malleable wire 34 is attached 46. It is preferable, but not limited to, the method of attachment be solder, weld, rubber sleeve, plastic collar, any other method of attachment that provides an uninterrupted line without friction. It is preferable the malleable wire 34 be made of a malleable or soft metal such as but not limited to copper or aluminum with a diameter 70 massive enough to support weighty garments and withstand reconfigurations while holding foam housing 36 (FIG. 10) in position. As shown in FIG. 10*a* the unattached tip 40 of the malleable wire 34 should be crimped 35 or folded upon itself to create a rounded end so as not to pierce foam housing 36 unit that surrounds the hanger frame 31see FIG. 10. The foam housing 36 is an elongated tube having a central aperture 87 that should be equal to or slightly greater than the diameter 70 of malleable wire 34 and the outside dimension 59 of the left rigid arm 26. The foam housing 36 should have an outside diameter 44 massive enough to support weighty garments and distribute the weight of garment and slight enough that the malleable wire 34 may hold the arm extensions 56 (FIG. 7) given shape without rebounding and can maintain any given position without aid. The foam housing 36 is of a length 36*a* greater than the length 26*a* (FIG. 10*a*) of rigid arm 26 plus the length 34*a* (FIG. 10*a*) of malleable wire 34 plus a length 60 (FIG. 4) equal to or greater than two times the outside diameter 44 of the foam housing 36.

Figure 4:
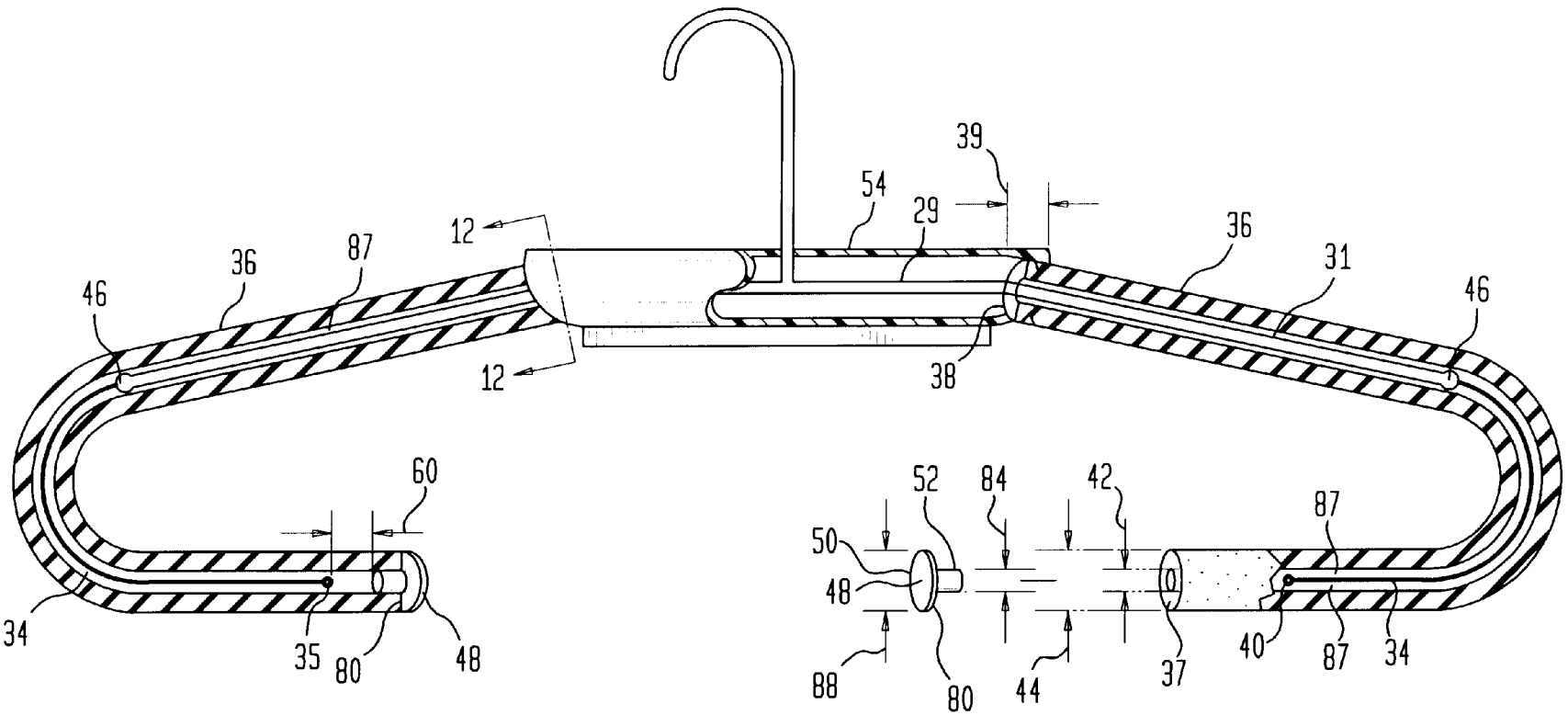
FIG. 4 is a sectional view of preferred embodiment FIG. 1.

As shown in FIG. 4 the above relative dimensions allow the malleable wire crimp 35 to be a distance 60 equal to or greater than the outside diameter 44 of foam housing 36 thus providing a sufficient distance 39 at the top tip 38 of the foam housing 36 downward to ensure collar teeth 62 (FIG. 12) engage foam housing 36 as shown in FIG. 4. It is preferable but not necessary that hanger frame assembly 31 in FIG. 10 be glued to the foam housing aperture 87. Gluing is accomplished by coating the inside diameter 42 (FIG. 4) of the foam housing aperture 87 with an adhesive such as glue, epoxy or other adhesives before assembling the foam housing 36 with hanger frame assembly 31 see FIG. 10.

Figure 9:
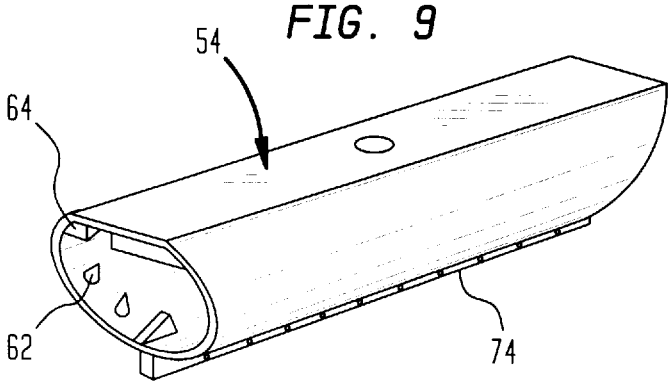
FIG. 9 is a perspective view of molded collar for use in conjunction with the present invention.
Figure 14:
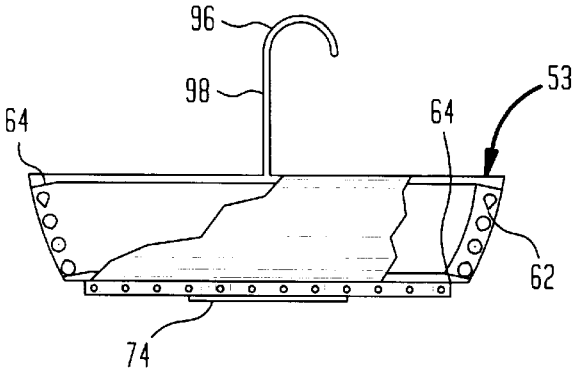
FIG. 14 is front sectional view of FIG. 8.
Figure 14A:
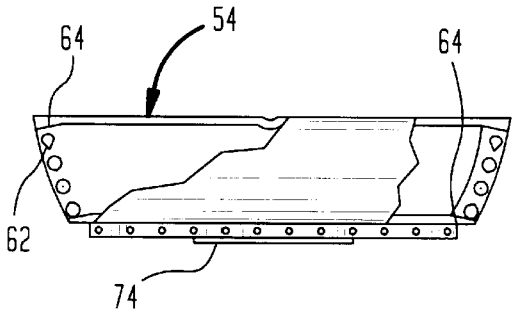
FIG. 14*a* is a front sectional view of FIG. 9.
Figure 15:
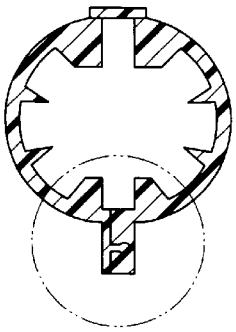
FIG. 15 is a side view of FIG. 14*a*.

A molded plastic collar 54 (FIG. 4) is then arranged over hook 23 neck 22 (FIG. 5) portion of the hanger frame 29 then placed over and around the arm assembly 56 (FIG. 7) as shown completed in the sectional view in FIG. 4. The collar 54 has a ring of teeth 62 (FIG. 9) on both the left and right side semi diameters. These teeth 62 engage foam housing 36 and aid in keeping the foam housing 36 in position as shown in sectional view FIG. 12. The collar 54 also has on either end a top and bottom ramp 64 (FIG. 14*a*) on both the top and bottom of the collar 54, these aid in positioning the foam housing 36 as shown in FIG. 4.

Figure 12:
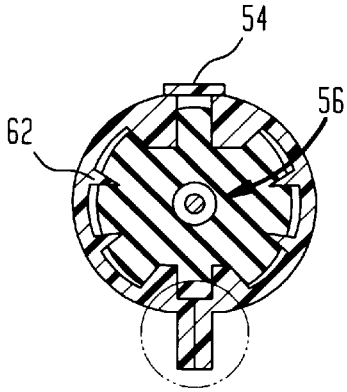
FIG. 12 is a cut away view of FIG. 4.
Figure 16:
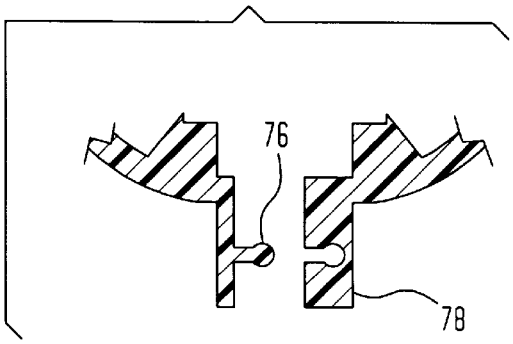
FIG. 16 is a detail enlargement of FIG. 15.

In addition, the collar 54 has a series of protrusions 76 and receptacles 78 (FIG. 16) located along the bottom edge 74 (FIG. 9) of the collar 54. The collar is snapped closed using the protrusions 76 and receptacles 78 as shown in FIGS. 12 and 4. FIG. 4 shows a plug 48 with a head 50 having an outside diameter 88 that is equal to the outside diameter 44 of the foam housing 36 and a nipple 52 whose outside diameter 84 is slightly less than the inside diameter 42 of the foam housing aperture 87. The bottom inside edge 80 of plug 48 is covered with glue and the nipple 52 is inserted into the foam housing aperture 87 at the far most tip 37 portion of the foam housing 36.

Figure 2:
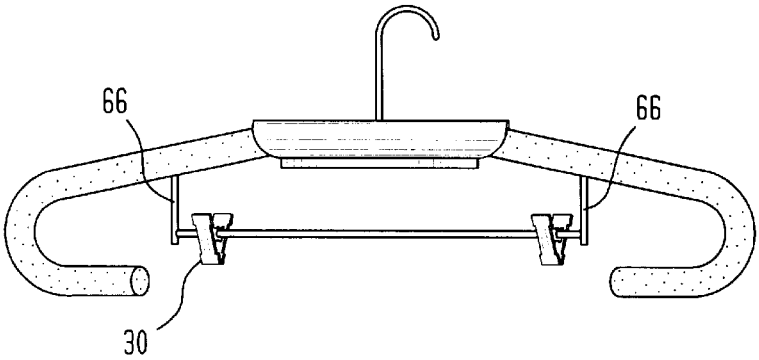
FIG. 2 is a perspective view of a flexible hanger with common skirt clips in accordance with the present invention.
Figure 3:
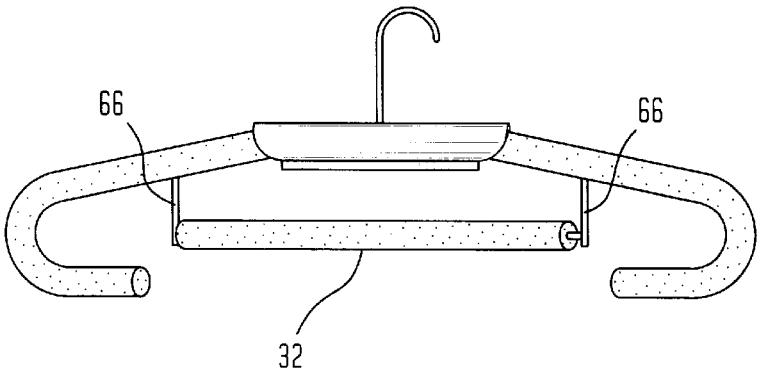
FIG. 3 is a perspective view of a flexible hanger with a common pants bar in accordance with the present invention.

FIGS. 2 and 3—Additional Embodiments

Figure 13:
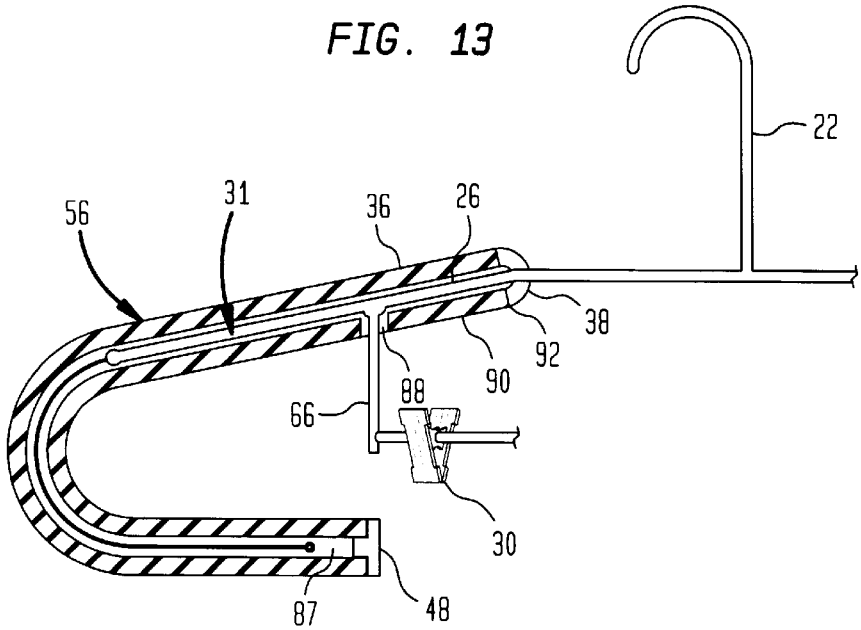
FIG. 13 is a sectional view of left arm assembly from FIG. 2 with the vertical bar assembled.

If there are attachments, such as skirt clamps 30 (FIG. 2) or pants bar 32 (FIG. 3) the vertically positioned bar 66 is attached to left rigid arm 26 (FIG. 13) and the right rigid arm 28. Attachment is by soldering, welding, gluing, screwing, molding or other attachment process to secure the skirt clip vertical bar 66 or the vertical pant bar 67 to the rigid arm 26. A diameter 88 equal to the inside diameter 42 (FIG. 4) of the foam housing 36 shall be place parallel to the neck 22 on the bottom edge 90 of the foam housing 36. A slit 92 shall be placed extending from the top tip 38 of the foam housing 36 to the aperture 88 and to center of foam housing aperture 87. In such manner, the arm assembly of FIG. 13 and foam housing 36 is used in lieu of the arm assembly of FIG. 7.

FIGS. 17, 18, 19, 20 and 20*a*—Alternate Embodiments

Figure 8:
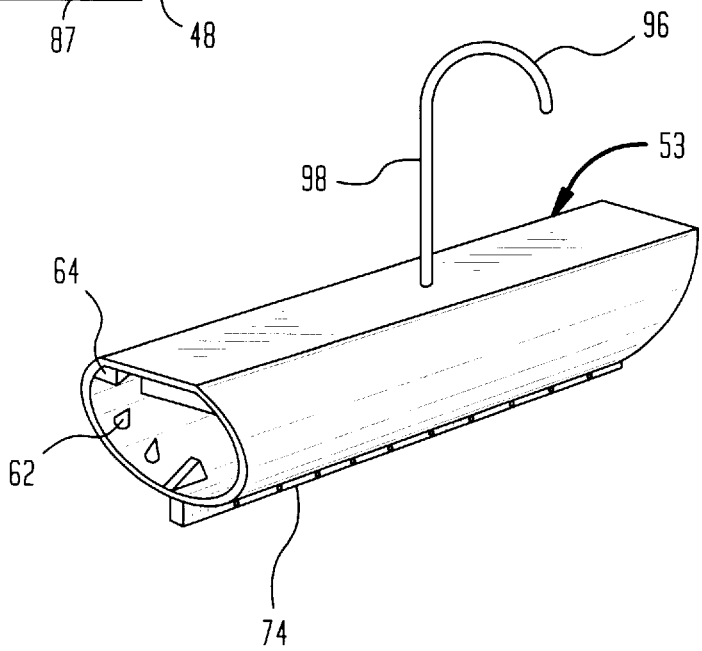
FIG. 8 is a perspective view of molded collar with integral hook for use in conjunction with the present invention.
Figure 17:
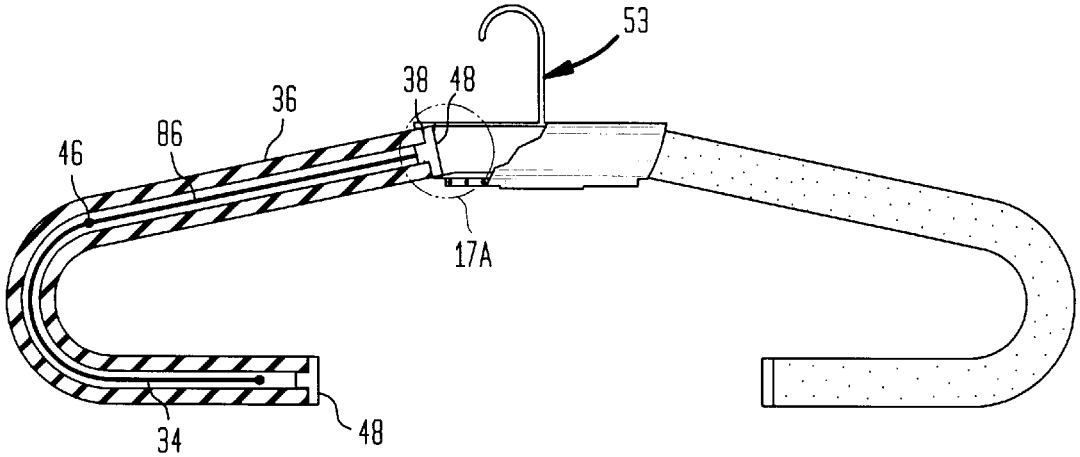
FIG. 17 is a perspective view of a flexible hanger in accordance with the present invention depicting an alternate construction and assembly method.
Figure 17A:
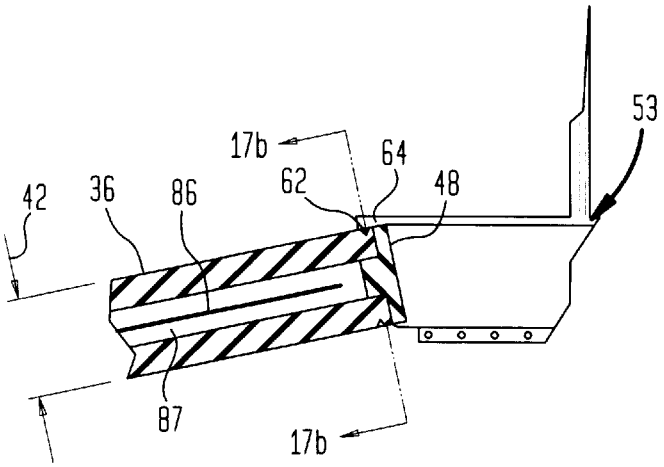
FIG. 17*a* is an enlarged detail view of FIG. 17.
Figure 17B:
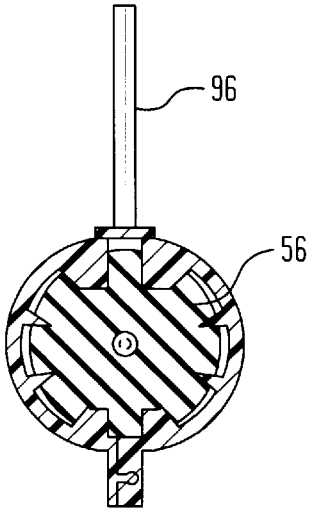
FIG. 17*b* is a sectional view of FIG. 17*a*.

FIG. 17 depicts an alternative embodiment of the preferred method FIG. 4. The difference in FIG. 17 is that the collar 53 (FIGS. 8 and 14) wherein a plastic hook 96 and plastic neck 98 are molded as an integral part of collar 53. The collar 53 also has on either end a top and bottom ramp 64 (FIG. 14) on both the top and bottom of the collar 53, which aid in positioning the foam housing 36 as shown in FIG. 17*a*. The collar 53 has a ring of teeth 62 (FIG. 17*b*) on both the left and right side semi diameters. The teeth 62 aid in keeping the foam housing 36 in position. In addition, the hanger frame 29 (of FIG. 4) is eliminated and replaced by a straight bar 86 made of steel, hardened metals, rigid plastics or wood providing a structure with a rigid profile strong enough to hold relatively heavy garments. In addition, the top tip 38 of foam housing 36 requires a plug 48.

Figure 18:
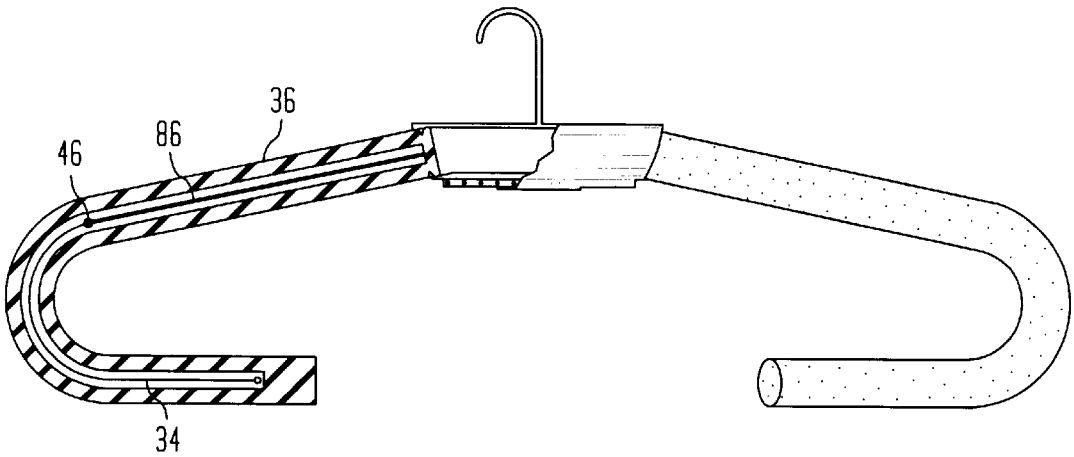
FIG. 18 is a perspective view of a flexible hanger in accordance with the present invention depicting an alternate construction and assembly method.

FIG. 18 represents another alternative embodiment of the preferred method and construction of FIG. 4. The difference in FIG. 18 is that the collar 53 replaces collar 54. The hanger frame 29 (of FIG. 4) is eliminated and replaced by a straight bar 86 and the foam housing 36 encapsulate straight bar 86 and attached 46 malleable wire 34 as it is extruded. This would eliminate the end caps 48 (of FIG. 4).

Figure 19:
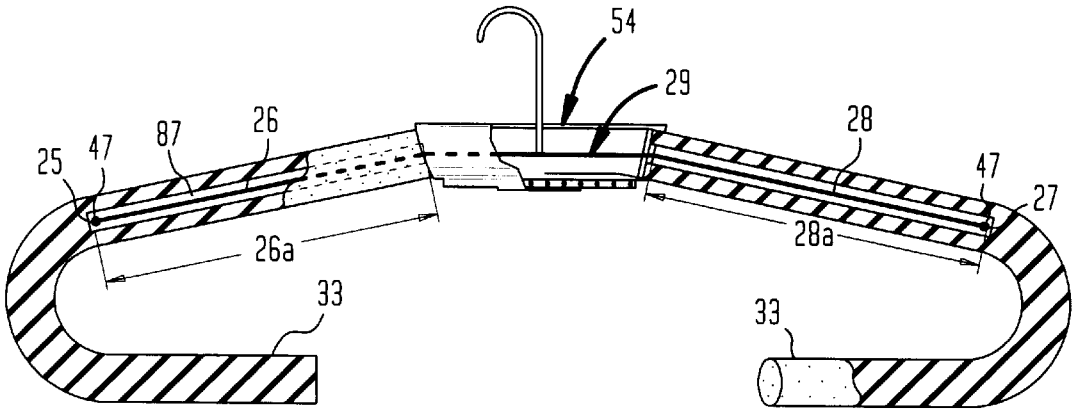
FIG. 19 is a sectional view of a flexible hanger with the present invention depicting an alternate construction and assembly method.

FIG. 19 represents another alternative embodiment of the preferred method and construction of FIG. 4. The difference in FIG. 19 is that a malleable foam housing 33 replaces the foam housing 36 and the malleable wire 34 is eliminated. The left rigid arm 26 of the hanger frame assembly 29 has at the tip 25 an end cap 47 also the right rigid arm 28 of the rigid frame assembly 29 has at the tip 27 an end cap 47. On the left side, the malleable foam housing 33 aperture 87 has a length slightly longer than the length 26*a* of the left rigid arm 26. The malleable foam housing 33 is 2 times the length of the left rigid arm 26*a*. Similarly, on the right side, the malleable foam housing 33 aperture 87 has a the length 28*a* slightly longer than the right rigid arm 28 and the malleable foam housing 33 is twice the length of 28*a*. By use of a malleable foam housing, the malleable wire 34 (FIGS. 4, 18 and 20) has been eliminated.

Figure 20:
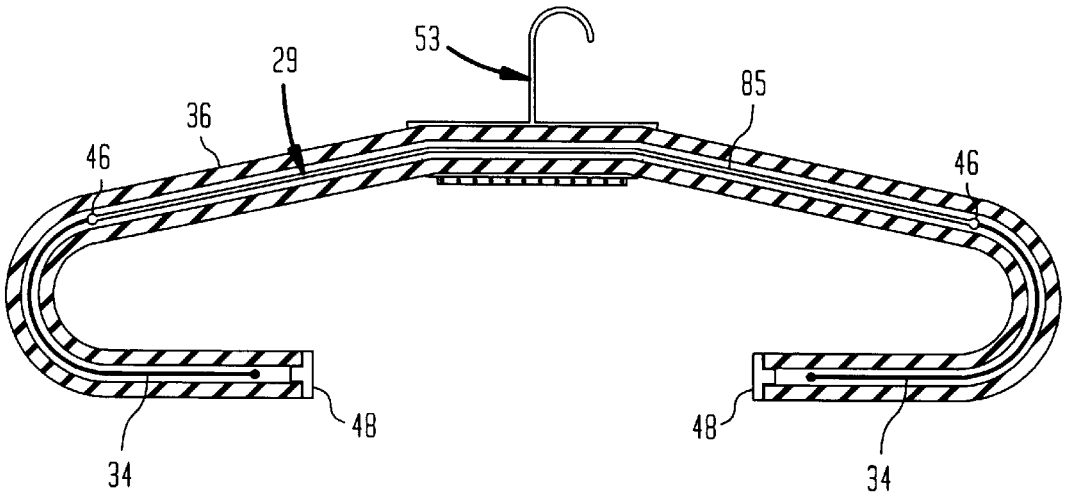
FIG. 20 is a perspective view of a flexible hanger in accordance with the present invention depicting an alternate construction and assembly method.

FIG. 20 represents another alternative embodiment of the preferred method and construction of FIG. 4. The difference in FIG. 20 is in the formed bar 85 to which malleable wires 34 are attached at each end 46. The foam housing 36 length is equal to the length of hanger frame assembly 29 (FIG. 10*a*) from left to right crimps 35 and a distance equal to 2 times the outside diameter 44 (FIG. 10) of the foam housing 36. In addition, collar 53 (FIG. 8) is used in place of 54 (of FIG. 4).

Figure 20A:
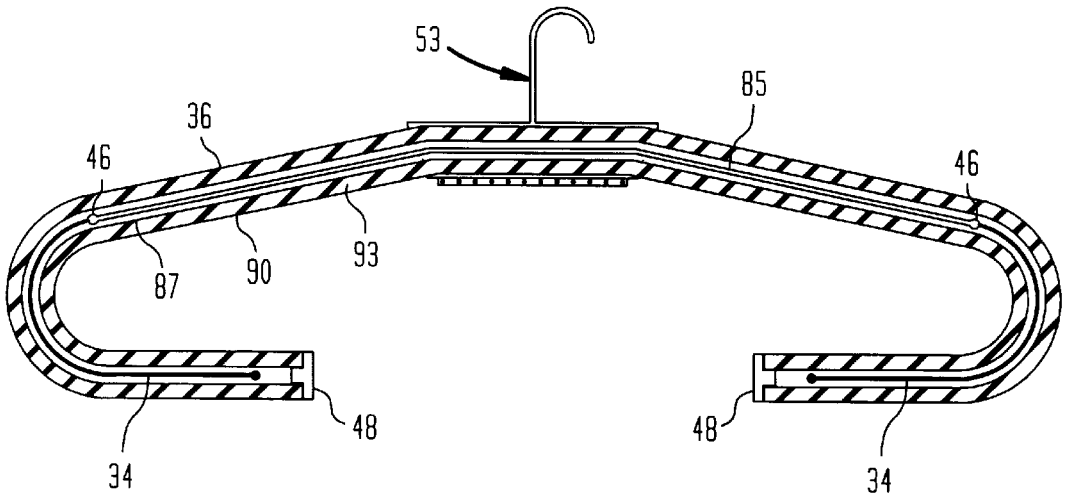

FIG. 20*a* represents another alternative embodiment of the preferred method and construction of a flexible garment hanger in accordance with the present invention. In FIG. 20*a*, a long slit 93 placed on bottom edge 90 of foam housing 36. The slit 93 permits a different method of manufacture by first centering the hangar assembly. Then, the foam housing 36 is wrapped around assembly 31 (FIG. 10*a*) and glued.

Figure 21:
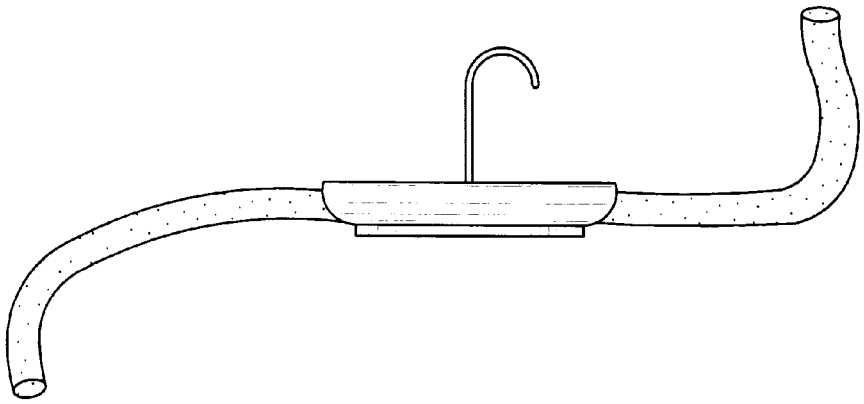
FIG. 21 is a perspective view of a flexible hanger in accordance with the present invention.

FIG. 21 Additional Embodiment

Figure 21A:
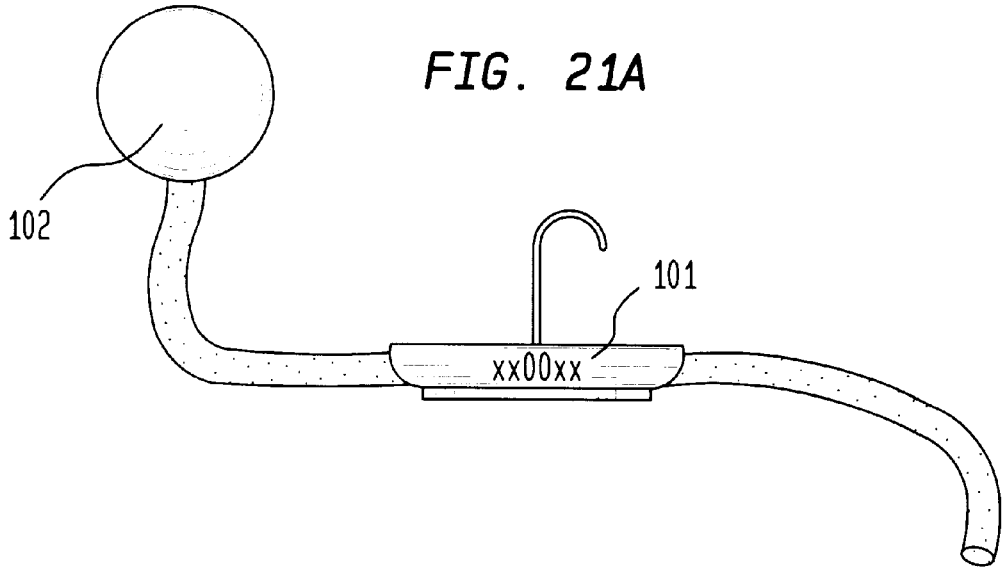
FIG. 21*a* is a perspective view of a flexible hanger in accordance with the present invention with embellishments.
Figure 21B:
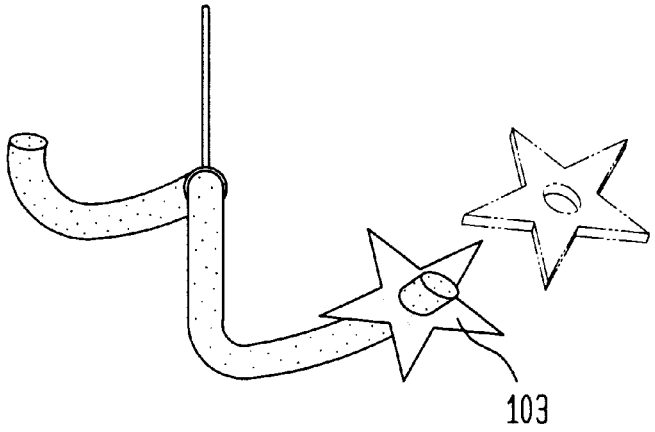
FIG. 21*b* is a perspective view of a flexible hanger in accordance with the present invention with embellishment.

FIGS. 21 and 21*a* show a front view and FIG. 21*b* shows a side view of the directionally unlimited range of motion included in the present invention. The full range of motion makes the construction of the flexible hanger of the present invention suitable for incorporation into a mannequin type device. In addition, the flexible hanger of FIGS. 1, 2, and 3 can be enhanced for display with add on features such as logos 101, a ball 102 and star 103 shown in FIGS. 21*a* and 21*b* respectively.

In operation, a clothing article is hung from the flexible hanger with the neck to shoulder seam of the garment aligned with the top surface profile of the hanger. To custom fit the flexible extension arms 56 (FIG. 1) place one hand over or under the clothing article and around a rigid member of the flexible extension arm 56 such as left rigid arm 26 (FIG. 5). Place the other hand over or under the clothing article and around the other flexible extension arm 56 such as the right rigid arm 28 (FIG. 5), and manipulated into the direction, length or shape needed to custom fit flexible hanger of FIG. 1 to the garment. The flexible extension arms 56 can be positioned in unison or one at a time.

The flexible extension arms 56 have a directionally unlimited range of motion and can also be posed as shown in FIGS. 21, 21*a* and 21*b* to represent the human form thereby making them useful for retail display applications. In application to mannequins, the collar 53 (FIG. 14) is equivalent to shoulders, while the neck 98 and hook 96 correspond to the neck and head of a mannequin, respectively.

Conclusion, Ramifications, and Scope

While my above description contains many specifications, these should not be construed as limitations on the scope of the invention, rather as an exemplification of one preferred embodiment thereof. Accordingly, the reader will see that the flexible hanger of this invention can be used to custom fit any garment easily and conveniently, can be adjusted to any reasonable configuration and reconfigured again within the same motion. The flexible hanger combines a non slip surface, an ample hanging surface and the ability to custom fit any garment. Because it is truly flexible and retains its given shape and because of it's directionally unlimited range of motion it is novel to the art. Furthermore the flexible hanger has the additional advantages in that Sweaters and knits can be hung and stored in closet on a conventional closet rod. Typically a sweater is stored on a shelf, in a sweater box. Storing a sweater like such takes up otherwise need space and the cost of storage devices that are far more expensive than the flexible hanger itself.

It permits the user to hang dry hand washables without the fear of causing garment to be permanently disfigured. Because of its slip free surface and ample hanging surface along with the arm extensions the weight of a wet garment is generously distributed across the top surface of the flexible hanger. Therefore any sweater, blouse, or clothing item with a neck and shoulder design can be hung to dry without wrinkling or distortion. Therefore the user saves on dry cleaning costs.

In that the hanger can be hung from a rod or hook it also saves the table or floor space otherwise needed to dry a knit garment.

It permits the user to increase the life expectancy of expensive clothing by providing a custom fit hanger that reduces stress, creasing and misshapen clothing.

Because the flexible hanger can be manufactured in any color available to foam it is eye catching and decorative. In addition, it can be embellished, that is to say, hands, heads, chests and other mimicking human form devices, as well as ball shape, conical shape and more can be added to the flexible hanger. With a compatible aperture human form devices may slide over the flexible hanger's arm tips or be situated elsewhere with the proper fastening devices. The molded collar can represent a face, logo or any relative designs. Therefore the flexible hanger, used alone or embellished, provides an inexpensive and space- efficient mannequin type device for the retail display industry.

Accordingly the scope of the invention should be determined not by the embodiments illustrated, but by the appended claims and their legal equivalents.

I claim:

1. A garment hangar comprising:

a neck section;

a pair of arms coupled to said neck section, and each of said arms having a respective first arm section coupled to said neck section and a respective second arm section coupled to said first arm section, said first arm section being more rigid than said second arm section so as to support more of the weight of said garment than said second arm section, said second arm section being more flexible than said first arm section, said second arm sections being malleable so as to be to shaped by hand to conform to the shape of said garment and retain said shape without external support, wherein each of said second arm sections of said pair of arms comprise:

a malleable wire; and a foam housing encasing said malleable wire.

2. A garment hanger comprising:

a neck section;

a pair of arms coupled to said neck section, and each of said arms having a respective first arm section coupled to said neck section and a respective second arm section coupled to said first arm section, said first arm section being more rigid than said second arm section so as to support more of the weight of said garment than said second arm section, said second arm section being more flexible than said first arm section, said second arm sections being malleable so as to be to shaped by hand to conform to the shape of said garment and retain said shape without external support, wherein:

said first arm section comprises a substantially rigid section for supporting the weight of said garment coupled to said neck section; and said second arm section comprises a malleable section coupled to said rigid section, wherein said malleable section is comprised of malleable foam.

3. A garment hangar comprising:

a neck section;

a pair of arms coupled to said neck section, and each of said arms having a respective first arm section coupled to said neck section and a respective second arm section coupled to said first arm section, said first arm section being more rigid than said second arm section so as to support more of the weight of said garment than said second arm section, said second arm section being more flexible than said first arm section, said second arm sections being malleable so as to be to shaped by hand to conform to the shape of said garment and retain said shape without external support, wherein each of said second arm sections of said pair of arms comprise:

a malleable wire; and a foam housing encasing said malleable wire, wherein said foam housing comprises a foam tube having an inner channel adapted tc receive said malleable wire.

4. A garment hangar, comprising:

a neck section;

a pair of arms coupled to said neck section, and each of said arms having a respective first arm section coupled to said neck section and a respective second arm section coupled to said first arm section, said first arm section being more rigid than said second arm section so as to support more of the weight of said garment than said second arm section, said second arm section being more flexible than said first arm section, said second arm sections being malleable so as to be to shaped by hand to conform to the shape of said garment and retain said shape without external support, wherein each of said second arm sections of said pair of arms comprise:

a malleable wire; and a foam housing encasing said malleable wire, wherein said foam housing has a non-slip outer surface for engaging the inner surface of said garment.

5. A garment hangar comprising:

a neck section;

a pair of arms coupled to said neck section, and each of said arms having a respective first arm section coupled to said neck section and a respective second arm section coupled to said first arm section, said first arm section being more rigid than said second arm section so as to support more of the weight of said garment than said second arm section, said second arm section being more flexible than said first arm section, said second arm sections being malleable so as to be to shaped by hand to conform to the shape of said garment and retain said shape without external support, further including a pant bar.

6. A garment hangar comprising:

a neck section;

a pair of arms coupled to said neck section, and each of said arms having a respective first arm section coupled to said neck section and a respective second arm section coupled to said first arm section, said first arm section being more rigid than said second arm section so as to support more of the weight of said garment than said second arm section, said second arm section being more flexible than said first arm section, said second arm sections being malleable so as to be to shaped by hand to conform to the shape of said garment and retain said shape without external support, and further comprising:

a hangar frame assembly including a rigid section forming first and second substantially rigid portions of said pair of arms, and a horizontal section connected to the respective proximal ends of said first and second substantially rigid portions;

a pair of malleable wires attached to the respective distal ends of said first and second substantially rigid portions;

a foam housing encasing said first and second substantially rigid portions and said pair of malleable wires; and a collar coupled to said neck section, said collar engaging said proximal ends of said first and second rigid sections.

7. A garment hangar comprising:

a neck section;

a pair of arms coupled to said neck section, and each of said arms having a respective first arm section coupled to said neck section and a respective second arm section coupled to said first arm section, said first arm section being more rigid than said second arm section so as to support more of the weight of said garment than said second arm section, said second arm section being more flexible than said first arm section, said second arm sections being malleable so as to be to shaped by hand to conform to the shape of said garment and retain said shape without external support, and further comprising:

first and second substantially rigid portions of said pair of arms;

first and second malleable wires attached to the distal ends of said first and second substantially rigid portions, respectively;

a first foam housing encasing said first substantially rigid portion and said first malleable wire;

a second foam housing encasing said second substantially rigid portion and said second malleable wire; and a collar coupled to said neck section, said collar engaging said proximal ends of said first and second rigid sections.

8. A garment hangar comprising:

a neck section;

a pair of arms coupled to said neck section, and each of said arms having a respective first arm section coupled to said neck section and a respective second arm section coupled to said first arm section, said first arm section being more rigid than said second arm section so as to support more of the weight of said garment than said second arm section, said second arm section being more flexible than said first arm section, said second arm sections being malleable so as to be to shaped by hand to conform to the shape of said garment and retain said shape without external support, and further comprising:

a hangar frame assembly including a rigid section forming first and second substantially rigid portions of said pair of arms, and a substantially horizontal section connected to the respective proximals end of said first and second substantially rigid portions; and a foam housing encasing said first and second substantially rigid portions, said foam housing having a malleable section extending beyond the distal ends of said first and second substantially rigid portions.

9. A garment hangar comprising:

a neck section;

a pair of arms coupled to said neck section, and each of said arms having a respective first arm section coupled to said neck section and a respective second arm section coupled to said first arm section, said first arm section being more rigid than said second arm section so as to support more of the weight of said garment than said second arm section, said second arm section being more flexible than said first arm section, said second arm sections being malleable so as to be to shaped by hand to conform to the shape of said garment and retain said shape without external support and further comprising:

a hangar frame assembly having a rigid section forming first and second substantially rigid portions of said pair of arms, and a horizontal section connected to the respective proximal ends of said first and second substantially rigid portions and a pair of malleable wires attached to the respective distal ends of said first and second substantially rigid portions;

a foam housing encasing said hangar frame assembly; and a collar coupled to said neck section, said collar engaging said foam housing.

10. A garment hangar in accordance with claim 1, wherein said garment hangar is included in a mannequin assembly so that said pair of arms of said hangar are positioned to correspond to the respective arm portions of a mannequin.

11. A garment hangar in accordance with claim 2, wherein said garment hangar is included in a mannequin assembly so that said pair of arms of said hangar are positioned to correspond to the respective arm portions of a mannequin.

12. A garment hangar in accordance with claim 3, wherein said garment hangar is included in a mannequin assembly so that said pair of arms of said hangar are positioned to correspond to the respective arm portions of a mannequin.

13. A garment hangar in accordance with claim 4, wherein said garment hangar is included in a mannequin assembly so that said pair of arms of said hangar are positioned to correspond to the respective arm portions of a mannequin.

14. A garment hangar in accordance with claim 6, wherein said garment hangar is included in a mannequin assembly so that said pair of arms of said hangar are positioned to correspond to the respective arm portions of a mannequin.

15. A garment hangar in accordance with claim 7 wherein said garment hangar is included in a mannequin assembly so that said pair of arms of said hangar are positioned to correspond to the respective arm portions of a mannequin.

16. A garment hangar in accordance with claim 8, wherein said garment hangar is included in a mannequin assembly so that said pair of arms of said hangar are positioned to correspond to the respective arm portions of a mannequin.

17. A garment hangar in accordance with claim 9, wherein said garment hangar is included in a mannequin assembly so that said pair of arms of said hangar are positioned to correspond to the respective arm portions of a mannequin.

* * * * *